United States Patent [19]

Kreiss

[11] 4,044,405

[45] Aug. 30, 1977

[54] TARGET IN A BOWL OR URINAL TO ATTRACT THE ATTENTION OF URINATING HUMAN MALES

[76] Inventor: Joel S. Kreiss, Washington Valley Road, Martinsville, N.J. 08836

[21] Appl. No.: 652,816

[22] Filed: Jan. 27, 1976

[51] Int. Cl.[2] ..... A47K 17/00

[52] U.S. Cl. ..... 4/1

[58] Field of Search ..... 4/1; 273/127 R, 102 R

[56] References Cited

U.S. PATENT DOCUMENTS

| | | | |
|---|---|---|---|
| 2,703,407 | 3/1955 | Henoch et al. | 4/1 |
| 2,931,047 | 4/1960 | Stebbins | 4/1 |
| 3,212,104 | 10/1965 | Stevens | 4/1 |

*Primary Examiner*—Henry K. Artis

*Attorney, Agent, or Firm*—David S. Woronoff

[57] ABSTRACT

A target fixedly connected to a urinal or toilet to attract the attention of human males.

8 Claims, 4 Drawing Figures

TARGET IN A BOWL OR URINAL TO ATTRACT THE ATTENTION OF URINATING HUMAN MALES

BACKGROUND OF THE INVENTION

Attracting the attention of urinating males to help in toilet training or to aid in keeping toilets, urinals and the areas around them clean has long been known to be desirable.

Parents, janitors, and others responsible for this cleanliness have often despaired the human male sloppiness of failing to direct urine into the proper receptacles.

Whether dealing with infants or males of other ages, it is well known that the male will direct his urine at a target if one is presented to him.

BRIEF DESCRIPTION OF THE PRIOR ART

A study of the prior art reveals that various types of devices for attracting the attention of human males are known.

One of these is a rotatable propeller suspended by struts over a toilet. The struts are connected by a ball and socket arrangement to a suction cup which is in turn attached to the external side of the toilet. The invention is taught by U.S. Pat. No. 2,703,407 issued to R. E. Henock et al on Mar. 8, 1955.

Other types of devices are known which sense a change in weight or water level in the toilet bowl and cause a music or chime box to become active.

SUMMARY OF THE INVENTION

The present invention teaches a novel target structure which may be positioned low in the bowl of a toilet or a urinal and which will not have to be removed or rendered inoperative when the toilet is cleaned or used for purposes other than male urination.

The present invention teaches a target which can be kept submerged in the toilet or bowl and will not be affected by either the flushing fluid or the urine or other substances commonly found to be flushed in toilets or urinals.

The present invention teaches a target which is safe, sanitary and which does not require independent cleaning.

DESCRIPTION OF THE INVENTION

Figure 2:
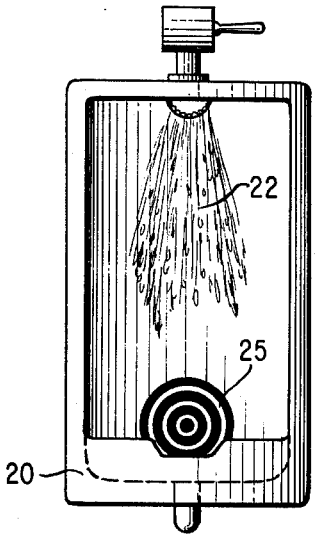
FIG. 2 shows the present invention in an embodiment with a conventional urinal.
Figure 1:
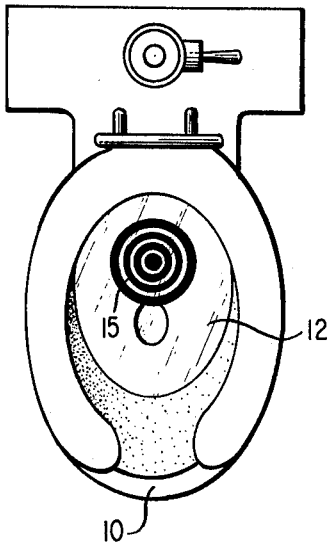
FIG. 1 shows the present invention in an embodiment with a conventional toilet.

FIGS. 1 and 2 show targets 15 and 25 disposed respectively in receptacles 10 and 20 shown as a toilet and a urinal. Target 15 is disposed below the water line 12 of the toilet and target 25 is disposed underneath the normal flow of water 22 in the urinal.

Figure 3:
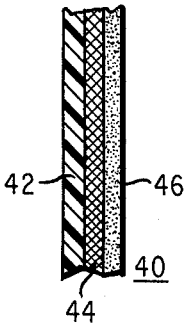
FIG. 3 shows a cross section of one embodiment of the present invention.
Figure 4:
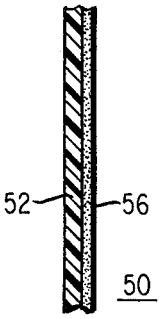
FIG. 4 shows a cross section of a second embodiment of the present invention.

The target 40, as shown in FIG. 3, is formed from a picture of a "bull's eye," an animal, or any other graphic representation, formed on paper, cardboard or any other suitable intermediate material 44. A coating 42 encapsulates the material 44 and an adhesive 46 is put on the coated material 44 for causing the package to adhere to the bowl of the receptacle. In another embodiment the coating 42 and the adhesive 46 may each form about half of the encapsulant, i.e. the coating need not totally enclose the intermediate.

The target 50 is formed of a suitable waterproof material 54 which is formed into the desired shape and design. An adhesive 56 is attached to the material 52 for enabling the attachment of the material 54 to the receptacle.

The coating 42 and the material 52 may be made of a variety of waterproof materials. Natural rubber, synthetic rubber, polyolefin, polyester and polyvinyl have been shown to be particulary suitable since they can take designs and colors. The materials chosen must have sufficient flexibility to take the shape of a surface curving in two or three dimensions.

The adhesive 46,56 may be chosen from a wide variety of non-water soluble materials.

Acrylic based, rubber based, or synthetic rubber based or any combination of those three may be used with special effectiveness.

In particular the above adhesives may be used in combination with the previously listed materials for achieving a good combination in order to secure the target to the receptacle.

Thus, a natural rubber, synthetic rubber, polyolefin, polyester or polyvinyl target may have an adhesive which may be one or more of acrylic based, synthetic rubber based or rubber based. When these combinations of materials are used, the target can only be removed by destroying or damaging it and can be said to be "non-removably" connected.

A "release paper" is attached to the adhesive which is removed to expose the adhesive just prior to affixing the target to the bowl of the receptacle.

I claim:

1. In a toilet bowl or urinal the combination comprising:

A target means to attract the attention of urinating human males to be wholly disposed within the bowl or urinal and to be permanently connected to the bowl or urinal; said target means being flexible prior to being non-removedly connected; said target being disposed in said bowl or urinal such that no part of said target extends outside of the volume partially enclosed by said bowl or urinal; and said target being void of moving parts.

2. The combination in claim 1 wherein: the target comprises a first waterproof layer and a second adhesive layer which is not water soluble.

3. The combination in claim 2 wherein:

the target is sufficiently flexible to conform to a surface which curves in at least two directions.

4. The combination in claim 2 wherein: said waterproof layer completely encloses an intermediate member.

5. The combination in claim 2 wherein:

said first waterproof layer formed from one of a group of materials comprising natural rubber, synthetic rubber, polyolefin, polyester or polyvinyl.

6. The combination in claim 3 wherein:

said second adhesive layer is formed from a base of one of a group of acrylic, synthetic rubber, rubber or any combination of them.

7. The combination in claim 5 in which said second adhesive layer is formed from a base of one of a group of acrylic, synthetic rubber, rubber or any combination of them.

8. The combination of claim 2 wherein:

said target comprises an intermediate member completely enclosed by said first waterproof layer and said second adhesive layer.

* * * * *